US011142391B1

(12) United States Patent
O'Brien et al.

(10) Patent No.: US 11,142,391 B1
(45) Date of Patent: Oct. 12, 2021

(54) DISPENSER FOR PRESSURIZED CANISTER

(71) Applicant: AC AVALANCHE LLC, Valley View, OH (US)

(72) Inventors: Stephen William O'Brien, Fort Worth, TX (US); Todd Michael Coleman, The Colony, TX (US); Michael E Quest, Franklin, TN (US)

(73) Assignee: AC AVALANCHE LLC, Valley View, OH (US)

( * ) Notice: Subject to any disclaimer, the term of this patent is extended or adjusted under 35 U.S.C. 154(b) by 0 days.

(21) Appl. No.: 17/071,818

(22) Filed: Oct. 15, 2020

(51) Int. Cl.
*B65D 83/20* (2006.01)
*B65D 83/48* (2006.01)
*B65D 83/22* (2006.01)

(52) U.S. Cl.
CPC ..... *B65D 83/206* (2013.01); *B65D 83/48* (2013.01); *B65D 83/22* (2013.01); *B65D 83/226* (2013.01)

(58) Field of Classification Search
CPC ..... B65D 83/206; B65D 83/48; B65D 83/22; B65D 83/226; B67D 7/32; B67D 7/22
See application file for complete search history.

(56) References Cited

U.S. PATENT DOCUMENTS

| | | | | |
|---|---|---|---|---|
| 5,971,230 | A * | 10/1999 | Tanaka | B65D 83/44 222/402.11 |
| 6,260,739 | B1 | 7/2001 | Hsiao | |
| 6,431,168 | B1 * | 8/2002 | Rand | A61P 11/08 128/200.23 |
| 6,655,552 | B2 * | 12/2003 | Aiken | B65D 83/206 222/146.3 |
| 6,695,171 | B2 * | 2/2004 | Walters | B05B 11/3059 222/153.13 |
| 9,144,651 | B2 * | 9/2015 | Stuart | G06M 1/041 |
| 9,181,019 | B2 * | 11/2015 | Betts | B65D 83/205 |
| 9,915,357 | B1 | 3/2018 | Ehlert | |
| 9,933,318 | B2 | 4/2018 | Quest | |
| 10,173,492 | B2 | 1/2019 | Quest | |
| 10,571,042 | B2 | 2/2020 | Quest | |

* cited by examiner

*Primary Examiner* — Frederick C Nicolas

(57) ABSTRACT

A dispenser system for a canister. The system includes an actuator with universal and replaceable component parts. The actuator may include an actuator frame, plunger, control, stem connector and canister connector. The actuator may be within a housing form factor that holds additional sensors. The sensors may be removable components that are used as part of a larger canister system. The sensor may communicate with a mobile device to indicate when to stop dispensing contents from the canister. The sensor may additionally be designed to prevent inadvertent actuation until the sensor is removed.

21 Claims, 13 Drawing Sheets

DISPENSER FOR PRESSURIZED CANISTER

FIELD OF THE DISCLOSURE

The application relates generally to actuators and controls for pressurized canisters.

BACKGROUND

Actuators are used to control the outflow of gas or fluid products from pressurized containers—such as aerosol cans. The actuator is designed to facilitate the gas or fluid flow from the pressurized container to another location. The actuator may be designed to release the pressurized gas or fluid from an attached container when the actuator is depressed. When the actuator is released, the actuator stops the release of pressurized gas from the canister.

SUMMARY

The present disclosure provides a dispenser with an actuator for a pressurized canister. The actuator may provide a universal control that is operable with multiple housing configurations. The actuator may be part of a system and operate in connection with an additional component.

In some embodiments, the internal actuator components may form a connection to the canister and operate to control the release of contents from the canister. The internal components may include an actuator frame, actuator plunger and actuator control. The actuator frame may connect to the canister in some embodiments. The actuator frame may include channels corresponding to tabs on the actuator plunger to guide the movement of the plunger.

The actuator control may connect to the actuator frame and the actuator plunger. The actuator control may rotate around a pivot point at or near the connection with the actuator frame. When the actuator control rotates, it causes the actuator plunger to slide up or down within the actuator frame.

A stem connector may be located between the actuator plunger and the output of the canister in some embodiments. The stem connector may be attached to an output hose that may pass through the actuator plunger and actuator control. In some embodiments, the stem connector may include a port configured to fit a valve stem extending from the canister, referred to as a male valve. In other embodiments, the stem connector may include an extended valve stem that is configured to enter the output of the canister within the interior stem gasket, referred to as a female valve.

Some embodiments may include a canister connector separate from the actuator frame. The canister connector may include a port that fits over the canister's stem gasket. It may connect using a threaded connection, snap-fit connection, friction fit connection or other connection. The canister connector may hold the actuator frame to the canister. In some embodiments, the canister connector may include a seal to prevent leakage from the connection. Embodiments of the canister connector may include a ratchet having a series of teeth to orient a dispenser housing with the canister.

In some embodiments, the dispenser housing snaps together around the actuator frame. The dispenser housing may include one or more tabs to engage the ratchet of the canister and maintain an orientation of the dispenser housing with the canister.

In some embodiments, the dispenser may include a sensor holder built into the dispenser housing. The sensor may be a mechanical component, electronic component or other accessory. In some embodiments, the sensor is configured to be removable from the dispenser. The sensor may be designed to operate as an actuator lock to prevent use of the dispenser until the sensor is removed.

In some embodiments, the sensor may connect to a measurement feature within the dispenser and provide a sensor output. The sensor output may be a display, such as a digital display to show pressure in the canister output.

In some embodiments, the dispenser design includes a trigger component configured to operate the actuator. In other embodiments, the dispenser may include a button configured to operate the actuator.

A BRIEF DESCRIPTION OF THE DRAWINGS

Embodiments will now be described, by way of example only, with references to the accompanying drawings in which.

DETAILED DESCRIPTION

Figure 1:
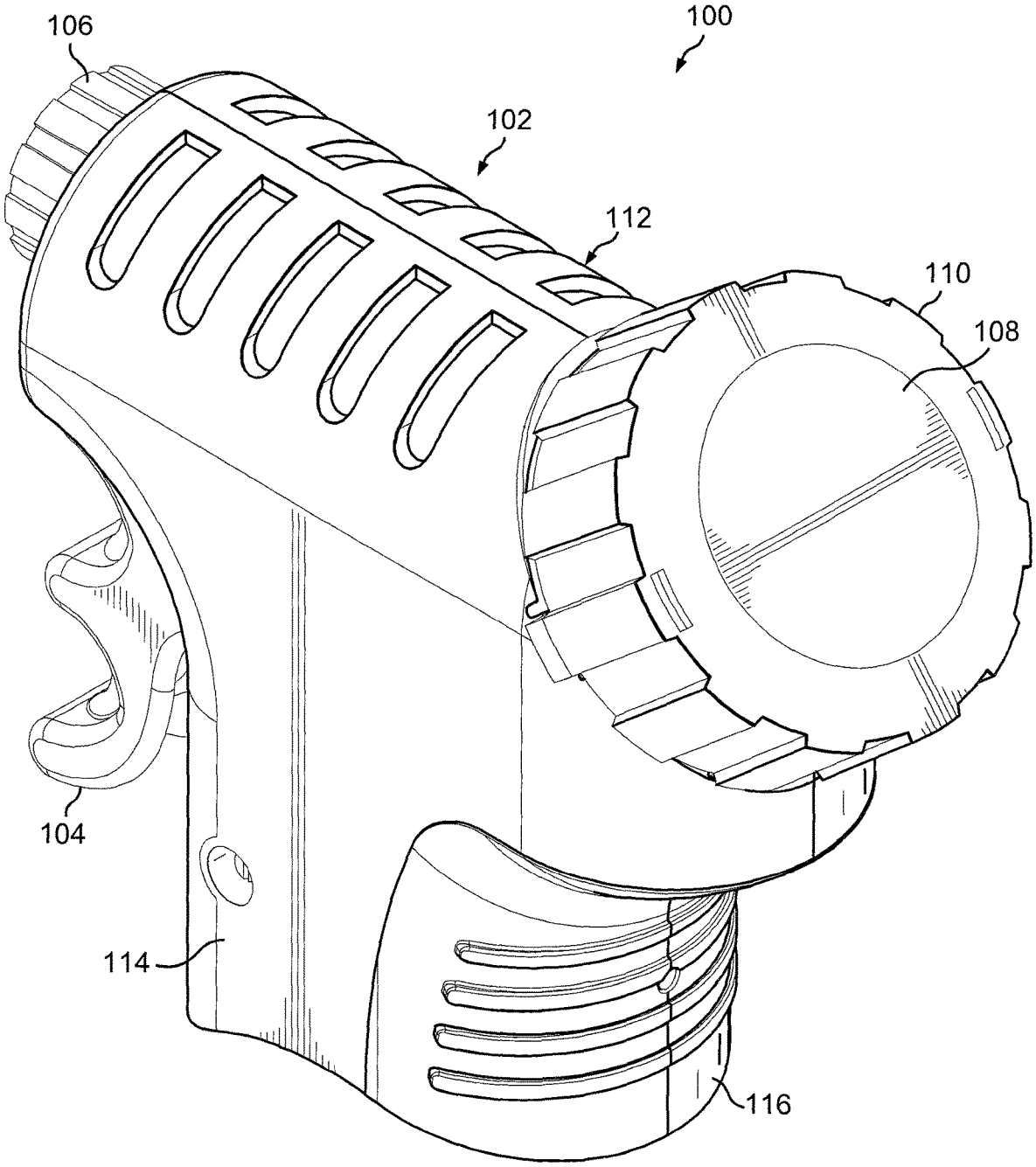
FIG. 1 is a perspective view of an embodiment of a dispenser.
Figure 2:
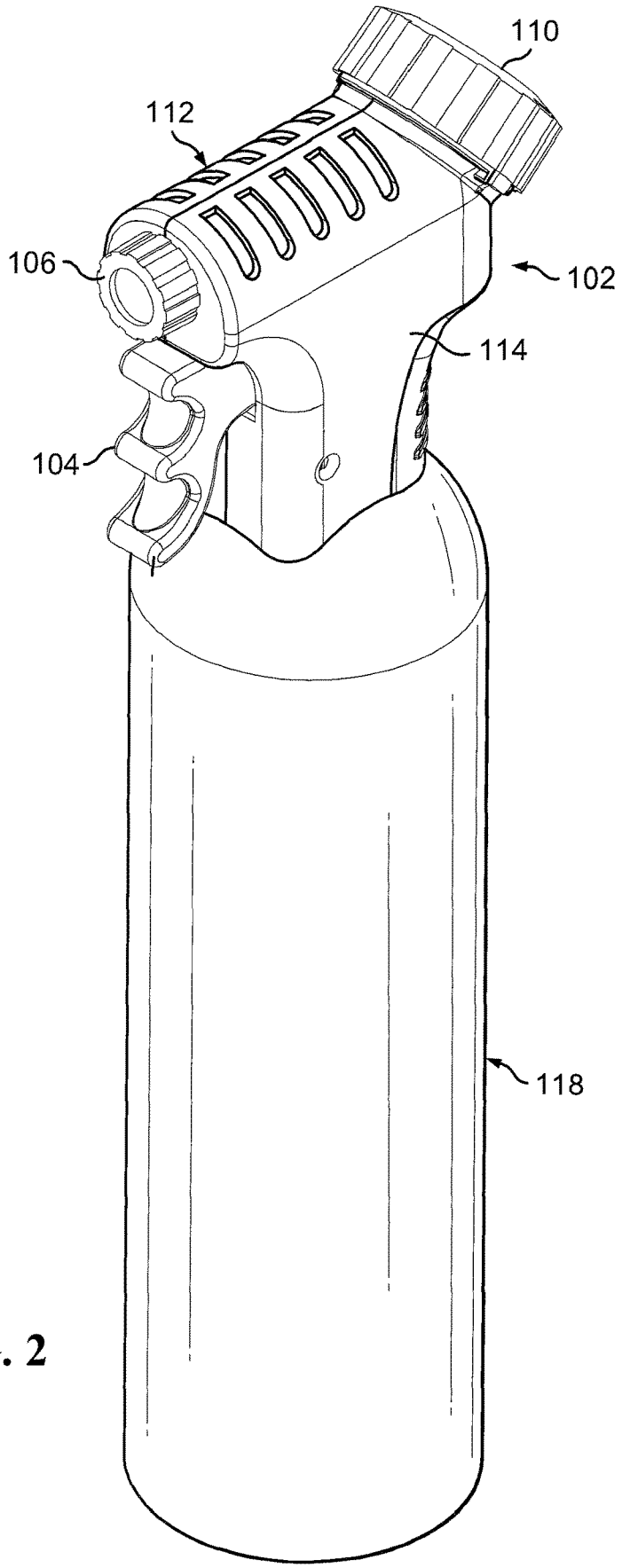
FIG. 2 is a perspective view of an embodiment of a dispenser and a canister.

While the subject matter of this application may be embodied in many different forms, there will herein be described in detail preferred embodiments with the understanding that the present disclosure is to be considered as an exemplification of the principles described and is not intended to limit the broad aspects described to the embodiments illustrated. It will be understood that the disclosure may be embodied in other specific forms without departing from the spirit or central characteristics thereof. For context, the orientation of the components may be referred to by directions (e.g., top, bottom, right, left, etc.) as shown in the figures. Those skilled in the art will recognize that during use these directions may be changed without changing the relationship between components. The present embodiments, therefore, are to be considered in all respects as illustrative and not restrictive, and are not to be limited to the details given herein.

FIGS. 1 through 7 depict an embodiment of a dispenser system having a dispenser 100 for a canister 118. In this embodiment, the dispenser 100 includes a dispenser housing 102, trigger 104, output fitting 106, sensor fitting 110 and sensor 108. The dispenser housing 102 includes sides walls 112 and 114 and back wall 116.

The side walls 112 and 114 extend from the back of the dispenser 100 to the front, wherein the dispenser output is located. The side walls 112 and 114 may attach to each other using a variety of connectors. For example, the side walls 112 and 114 may have corresponding snap-fit or friction fit components. In other embodiments, the dispenser 100 may include screws, bolts, pins or other connectors to hold the side walls 112 and 114 together. In some embodiments, the side walls 112 and 114 may connect to other components as well. For example, the side walls 112 and 114 may connect to the actuator frame 124.

In this embodiment, the side walls 112 and 114 form a control opening, an output opening and a sensor opening. The trigger 104 is located in the control opening, which is below the output opening. The control opening allows space for the trigger 104 to move and allow operation of the actuator. Those skilled in the art will recognize that the size and shape of the control opening may vary to correspond with varying designs of trigger 104. In some embodiments, the dispenser housing 102 may include an alternative control opening, such as a button opening, which may be located in the top of the dispenser housing 102.

The output opening is surrounded by the output fitting 106 in the front section of the dispenser housing 102. The output opening and output fitting 106 are configured to allow a hose, output tube or other component to disperse the contents of the canister 118 pass from a connection within the dispenser housing 102 out of the dispenser 100.

The sensor opening is in a back section of the dispenser housing 102. The sensor opening is surrounded by the sensor fitting 110. In this embodiment, the sensor 108 is fitted into the sensor opening and held in place by the sensor fitting 110. In some embodiments, the sensor fitting 110 is designed to temporarily lock the sensor 108 in place until the sensor 108 is removed for use. In other embodiments, the sensor fitting 110 may form a more permanent or semi-permanent connection to hold sensors 108 that are not intended to be removed. The sensor 108 may be any type of removable or installed design. In other embodiments, the sensor 108 may be replaced with another accessory item, such as a thermochromic clip, hose fitting or other accessory.

The back wall 116 may be used to hold the back section of the side walls 112 and 114 together in some embodiments. For example, the back wall 116 may include one or more prongs to form snap-fit connections on or within the side walls 112 and 114. The back wall 116 may prevent the inadvertent separation between the side walls 112 and 114. In some embodiments, the back wall 116 includes an opening to allow internal access to the dispenser housing 102. This opening may also facilitate the option to remove the back wall 116.

Figure 3:
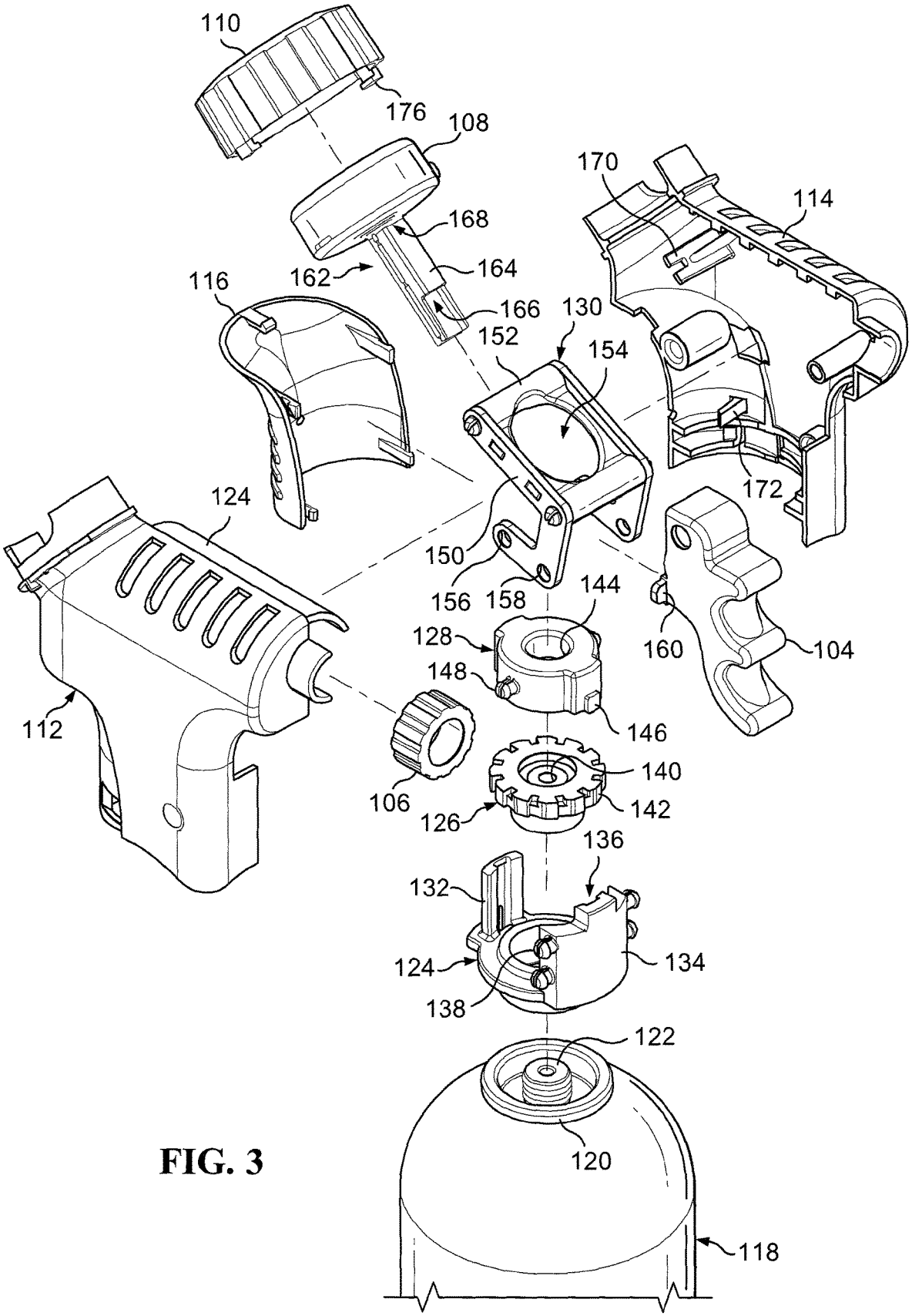
FIG. 3 is an exploded view of an embodiment of a dispenser and a canister.

The actuator components are within the dispenser housing 102. As illustrated in FIG. 3, the actuator includes an actuator frame 124, canister connector 126, actuator plunger 128 and actuator control 130, as well as a stem connector 204 (see FIG. 8). The actuator frame 124 includes a back guide wall 132 and a front guide wall 134 with guide channel 136. In this embodiment, the actuator frame 124 includes frame connectors 138 on the sides of the front guide wall 134. The actuator frame 124 fits into a mounting cup 120.

The canister connector 126 fits through the base of the actuator frame 124 and connects to a stem gasket 122 in the mounting cup 120 of the canister 118. In this embodiment, the stem gasket 122 includes threads for a connection with the canister connector 126. The canister connector 126 may attach to the canister 118 using any connector system, including friction connectors, snap-fit connectors, adhesive connectors or other connectors. In some embodiments, the thread direction may correspond to the product in the canister 118. For example, the stem gasket 122 may include a right-hand thread for r134a refrigerant and a left-hand thread for r1234yf refrigerant. Most actuator components may be universal, while the canister connector 126 may be interchangeable depending on the necessary thread direction for an application.

In this embodiment, the canister connector 126 includes a stem opening 140 and a ratcheted edge 142 having a series of protrusions or teeth separated by divots or indentions. This ratcheted edge 142 corresponds with tines 172 extending inward from the side walls 112 and 114. When assembled, the tines 172 fit into the divots of the ratcheted edge 142 to prevent inadvertent rotation of the dispenser housing 102 relative to the canister connector 126. The dispenser housing 102 may be rotated only when a sufficient force is applied, causing the tines 172 to flex and rotate around the ratcheted edge 142.

The actuator plunger 128 includes a nozzle opening 144, guide tabs 146 and plunger connectors 148. The guide tabs 146 are located on the front and back of the actuator plunger 128. The guide tabs 146 correspond to the front and back guide walls 134 and 132 in the actuator frame 124, and the guide tabs 146 fit in the guide channel 136. During operation, the guide tabs 146 slide in the guide channel 136. In some embodiments, the guide channel 136 may include a stop tab at the top to prevent the actuator plunger 128 from sliding out of the actuator frame 124 inadvertently.

A space 180 is between the actuator plunger 128 and the canister connector 126. During operation, this space 180 is larger when the actuator plunger 128 is lifted up and becomes smaller when the actuator plunger 128 is pushed down. A stem connector 204 (not shown in FIGS. 1-7) fits in the space 180. The stem connector 204 engages the output of the canister 118 through the stem opening 140 and includes an output nozzle 212 extending through the nozzle opening 144 in the actuator plunger 128. The stem connector 204 is configured to cause the release of the canister 118's contents when the actuator plunger 128 is compressed downward on the stem connector.

The actuator also includes the actuator control 130, which operates the actuator during use. In some embodiments, the actuator control 130 is formed from brackets 150 and control frame 152. The control frame 152 includes an opening 154 that allows a nozzle, extender or hose to pass through without interfering with the operation of the actuator. In this embodiment, actuator control 130 includes a bracket 150 on each side of the control frame 152.

In some embodiments, the brackets 150 have an angular design with a J-shape. In this embodiment, the top arms of the brackets 150 attach to the sides of the control frame 152 and form an obtuse angle with the connecting side of the brackets 150. The connecting side and the bottom arms of the brackets 150 form a right angle. Those skilled in the art recognize that the angles or curves built into the brackets 150 may vary to correspond with associated components including the actuator frame 124, actuator plunger 128, trigger 104 and other components.

The bottom arm of each bracket 150 includes an arm hole 156 and a corner hole 158. The arm hole 156 connects to the plunger connector 148 and the corner hole 158 connects to a frame connector 138. In the embodiment shown, these connections are snap-fit connections with the frame connector 138 and plunger connector 148 extending and snapping into the corresponding arm hole 156 and corner hole 158. The brackets 150 rotate around the frame connector 138 and corner hole 158 connection. Other embodiments may invert the connectors or use alternative connectors that allow the components to move during operation.

During operation, the actuator plunger 128 is pushed downward by the actuator control 130 when the distal end of the control frame 152 from the connecting side of the brackets 150 is moved downward. The distal end of the control frame 152 may be moved by downward pressure applied at the distal end of the control frame 152, which may be referred to as a top contact point. Alternatively, the distal end of the control frame 152 may be moved downward by a backward pressure applied on a front contact point along an upper portion of the connecting side of the brackets 150. In the embodiment shown, the trigger 104 includes sideways extending tabs 160, which push against the connecting side of the brackets 150 to move down the actuator control 130.

Figure 4:
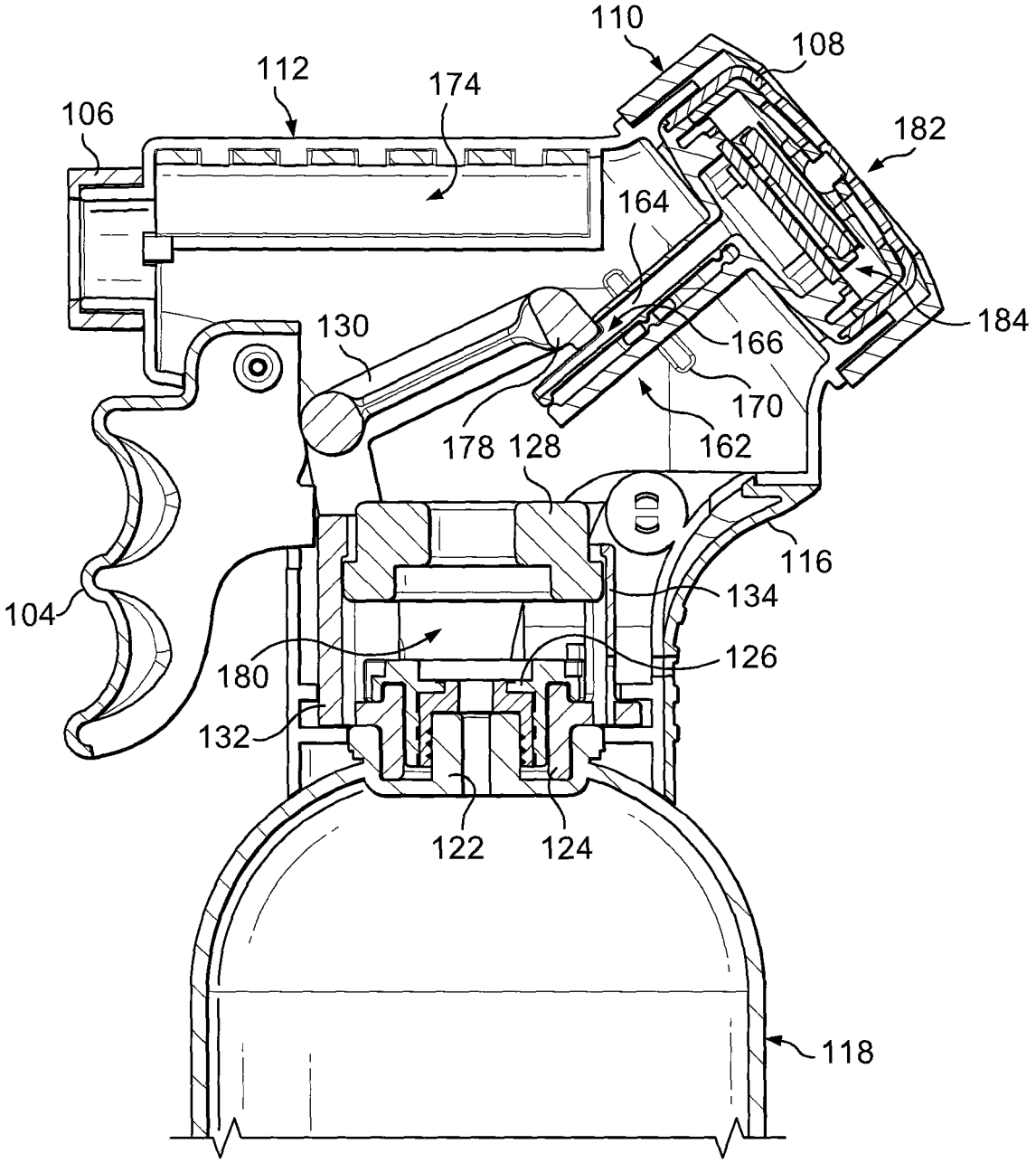
FIG. 4 is a cross-section view of an embodiment of a dispenser in a first position.

The exploded view in FIG. 3 and cross-section view of FIG. 4 also illustrate a cover 174 that fits into the dispenser housing 102. The cover 174 spans across the side walls 112 and 114 under a top surface of the side walls 112 and 114. In some embodiments, the cover 174 is visible through openings or windows in the side walls 112 and 114. In some embodiments, the cover 174 and the dispenser housing 102 may be customized for a product or company, through the use of materials, or colors, labels or other insignia.

In this embodiment, sensor 108 corresponds with the product in canister 118. For example, the canister 118 may contain a refrigerant and the sensor may be a temperature and humidity sensor. Sensor 108 is shown with a clip 162 with one arm that has an airflow channel 164. At the opening of the airflow channel 164, the arm forms a notch 166. The sensor 108 also includes a vent 168 for airflow on the side with the clip 162. On the opposite side from the clip 162 may be another vent 182, which allows the escape of air passing through the sensor 108. The two arms of the clip 162 are configured to snap over a vane, vent or other component in an airflow path, such as a vent in a car dash.

The sensor 108 includes electronics 184, which include the temperature and humidity sensor, microchip or microprocessor and wireless communication chip or module. These structural components may be built into the same chip or combined on a board. The wireless communication chip may be any type of communication module, such as BLUETOOTH, WIFI, ZIGBEE or other communication component, and may include an incorporated antenna or connect to an antenna. The electronics 184 also include a power source, such as a battery, which may be removable in some embodiments.

In this embodiment, the sensor fitting 110 also includes a locking arm 176 designed to grip the dispenser housing 102 around the sensor opening and hold the sensor 108 in place until use. The locking arm 176 may extend through a space in a shoulder formed around the sensor opening, wherein the locking arm 176 will lock into position when rotated by engaging the shoulder.

The side walls 112 and 114 also include corresponding protrusions 170 with a forked end. When the sensor 108 is inserted, the clip 162 fits around the corresponding forked ends of the protrusions 170. The protrusions 170 support the clip 162 within the dispenser housing 102 and prevent inadvertent movement of the sensor 108.

FIG. 4 illustrates a cross-section of the dispenser 100 attached to canister 118. In this embodiment, the distal end of the control frame 152 includes a nose 178 on the lower edge, which abuts the notch 166 on the clip 162. The nose 178 and notch 166 help limit how far the sensor 108 may slide into the dispenser housing 102. In addition, the clip 162 prevents the actuator control 130 from operating by preventing downward movement of the nose 178 when the clip 162 is in place. The protrusions 170 provide additional support to the clip 162 to prevent the clip 162 from rotating or flexing. This further prevents an inadvertent actuation and release of the contents of the canister 118.

In this view, the sensor 108 is in the dispenser housing 102 and the clip 162 is snapped onto the protrusions 170. In this position, the nose 178 of the actuator control 130 is abutting the clip 162 at the notch 166. The actuator plunger 128 is shown in a raised position corresponding to the position of the nose 178 of the actuator control 130.

Figure 5:
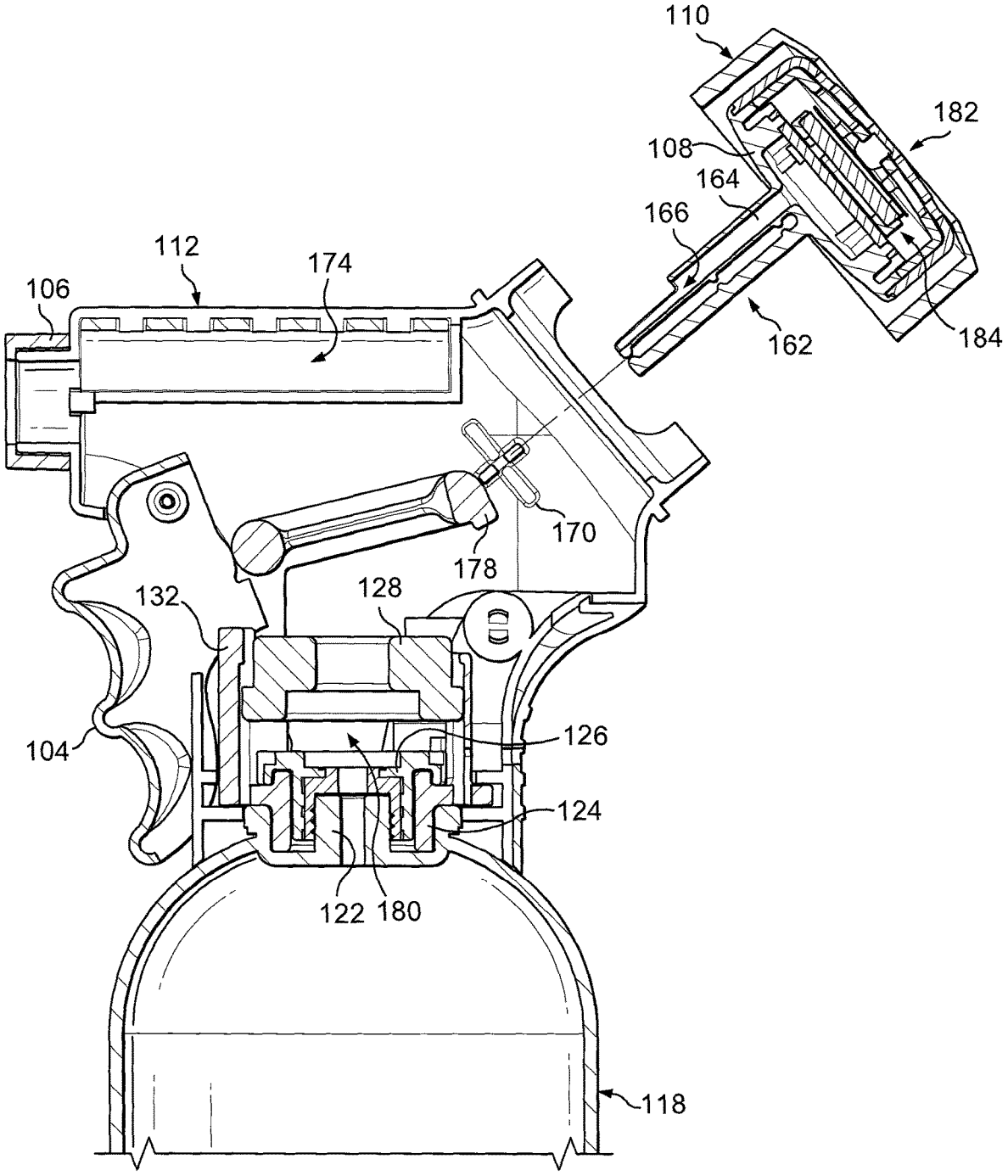
FIG. 5 is a cross-section view of an embodiment of a dispenser in a second position.

FIG. 5 illustrates a cross-section of the same dispenser 100. In this view, the sensor 108 is removed from the dispenser 100's sensor opening. The trigger 104 is pulled backwards, causing the actuator control 130 to rotate the nose 178 downward. This rotation also pushes the actuator plunger 128 toward the canister connector 126, compressing the space 180.

Figure 6:
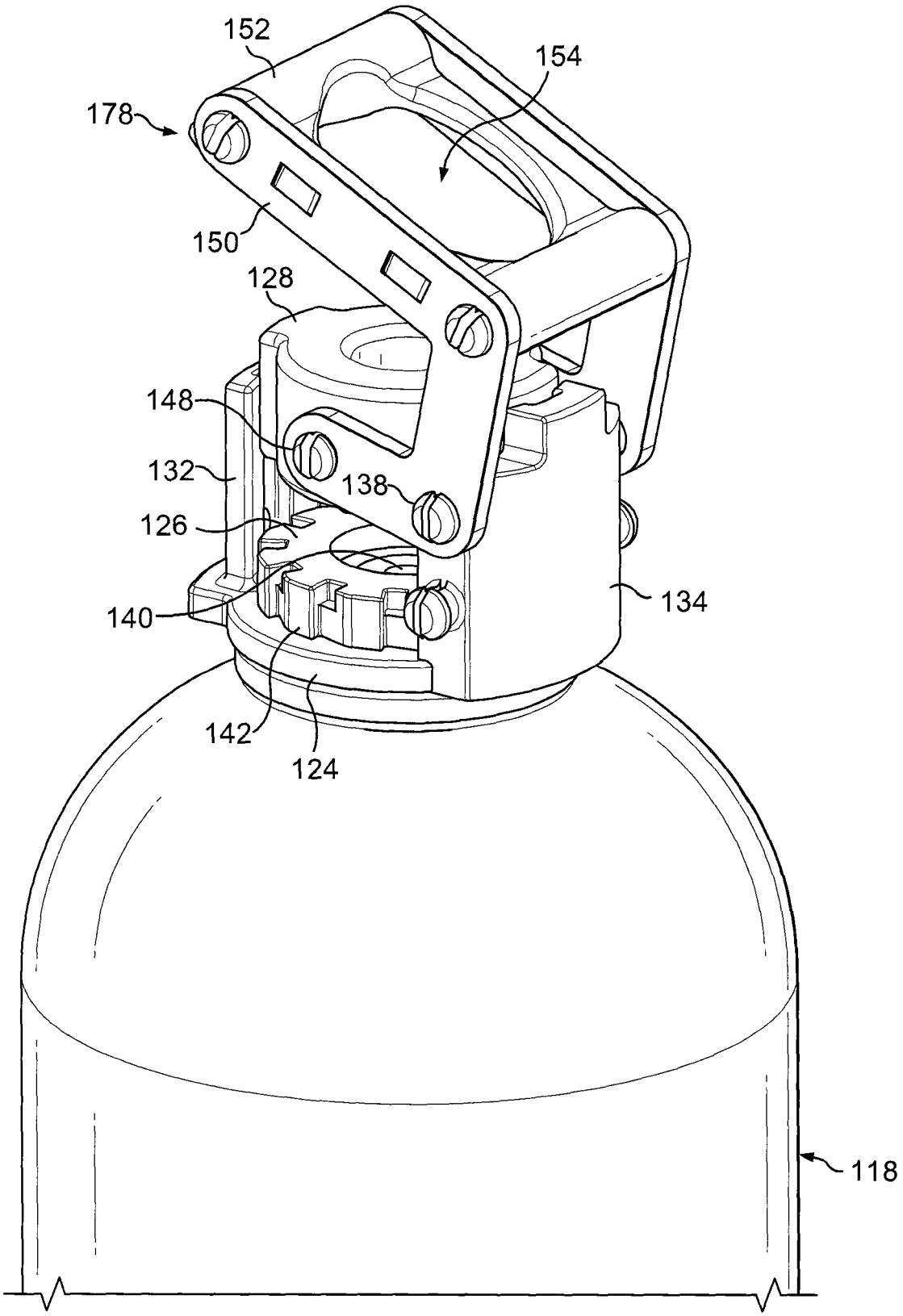
FIG. 6 is a perspective view of an embodiment of an actuator without a housing.

FIG. 6 shows the actuator without the dispenser housing 102. This actuator may be used within multiple forms for a variety of factors for dispenser housings. For example, an alternative dispenser housing 102 may provide an enclosure with a top button that pushes down on the distal end of the actuator control 130. In some embodiments, the actuator may be used in a dispenser including an electronic control feature. For example, the dispenser may include an electronic servo motor attached to the dispenser housing 102, which is configured to lock the actuator in a position to release contents of the canister until a signal is received to unlock the actuator to stop the flow.

Those skilled in the art will recognize that the flexibility provided by the actuator allows the same actuator to be used with multiple dispenser designs and reduces the amount of inventory to be stored and maintained to fit multiple canister designs and dispenser forms for various factors. This benefit is further enhanced by the universal components of the actuator and limited components that are interchangeable to fit the canister outputs.

Figure 7:
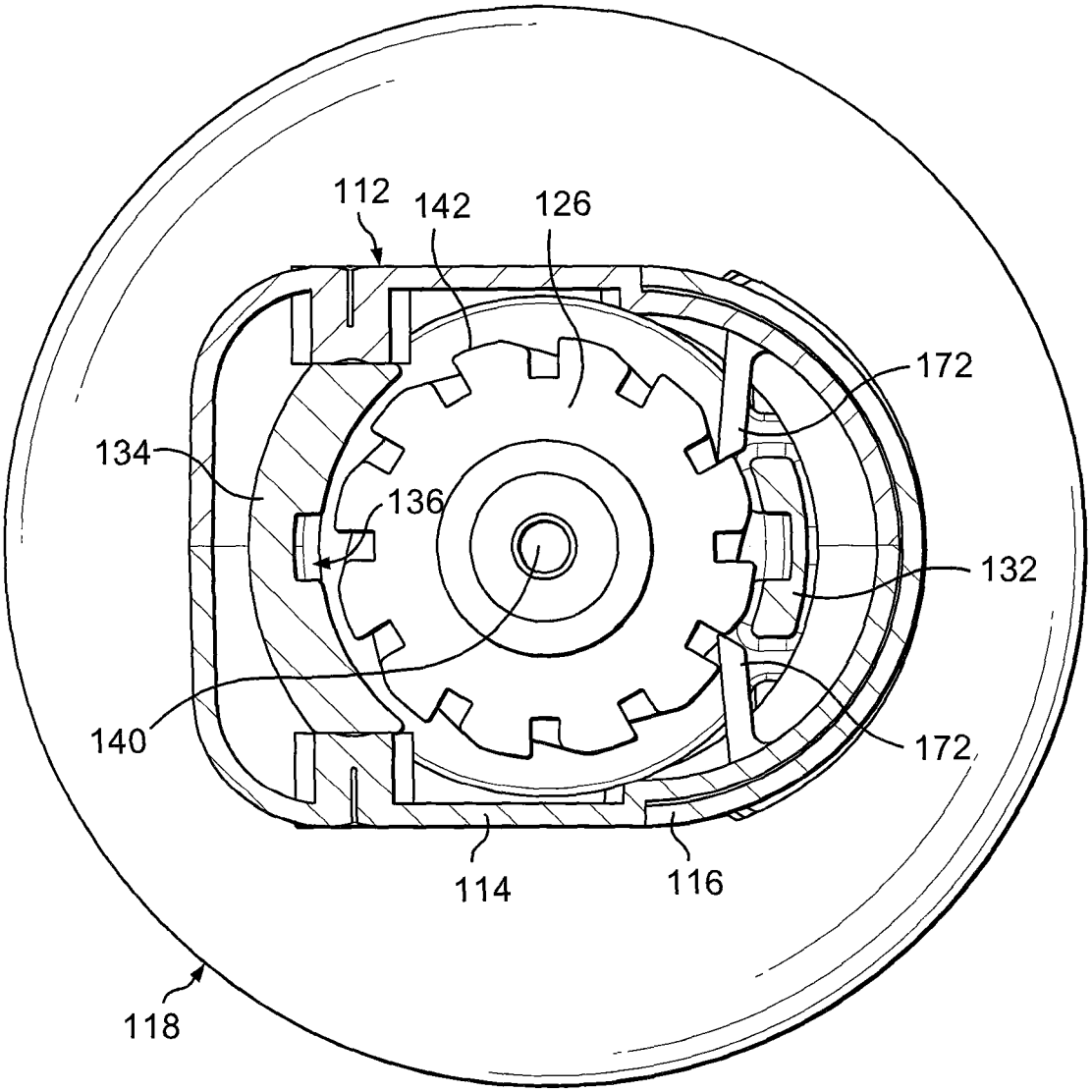
FIG. 7 is a top, cross-section view of an embodiment of a dispenser.

FIG. 7 shows a cross-section of the dispenser 100 from a top view at the canister connector 126. The tines 172 on each side wall 112 and 114 engage the ratcheted edge 142 of the canister connector 126. In this configuration, the angled points of the tines 172 and angled edges of the teeth on the ratcheted edge 142 correspond to limit the ability to rotate the dispenser housing 102 relative to the canister connector 126 and the canister 118. In this configuration, the tines 172 and the ratcheted edge 142 prevent the dispenser housing 102 from rotating in a clockwise direction because the tine 172 on side wall 112 will wedge into the divot between teeth based on the angles. In addition, the tine 172 on side wall 114 will limit any counter-clockwise rotation until a sufficient pressure is applied to cause the leading angle of the ratcheted edge 142 and the angle of the tine 172 to pass each other and allow rotation.

This allows a company to properly align the dispenser 100 with the canister 118. Aligning the canister 118 with the dispenser 100 may provide an operational benefit, such as ensuring that an internal tube within the canister 118 is placed in a preferred orientation for efficient dispensing. Alignment may also provide a marketing or aesthetic benefit by ensuring the dispenser 100 is in a preferred orientation to allow for improved readability of the canister 118's label.

Figure 8:
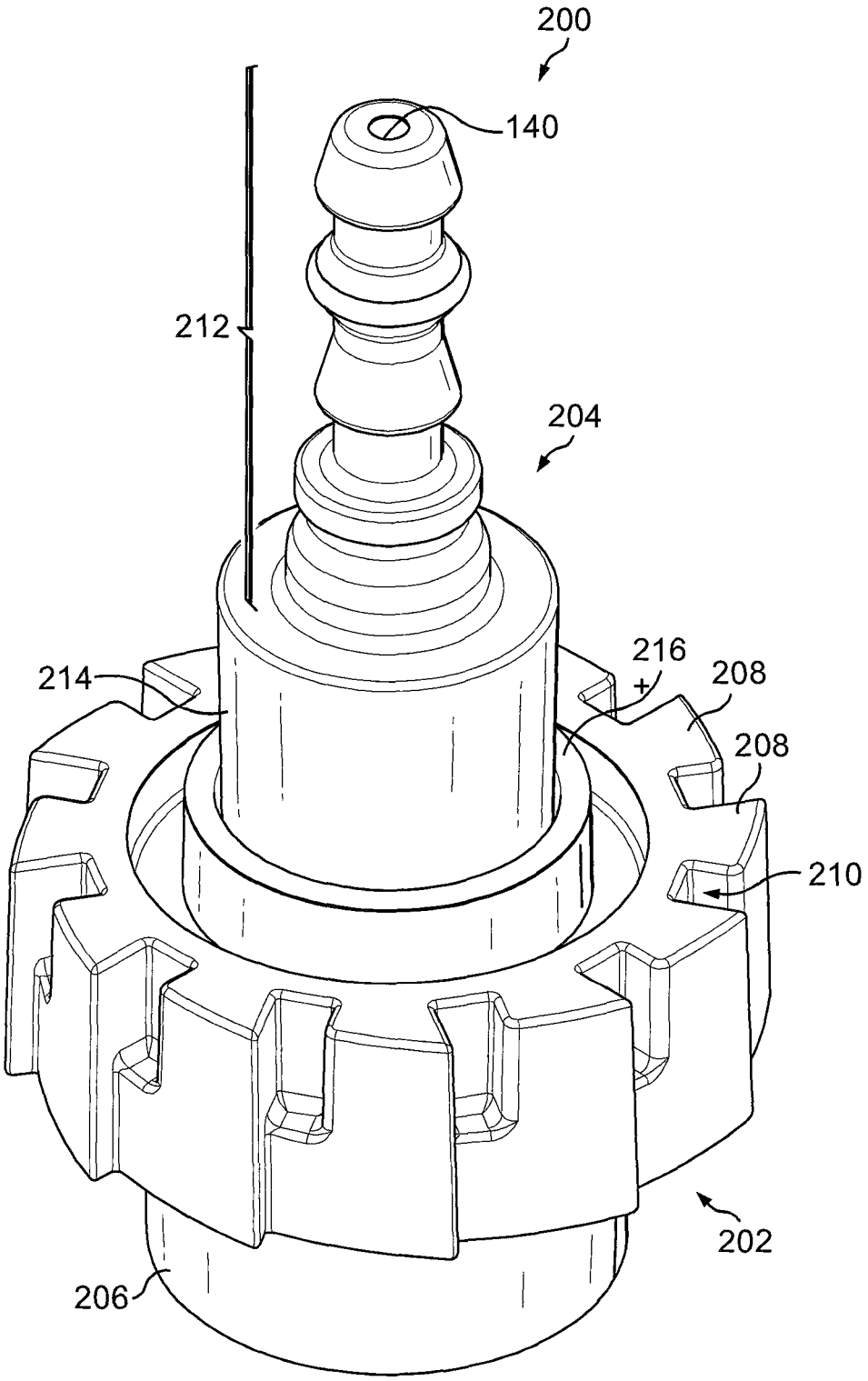
FIG. 8 is a perspective view of an embodiment of a canister connector and stem connector.

FIG. 8 shows a combination 200 comprising a canister connector 202 and stem connector 204. The canister connector 202 shows an alternative ratcheted edge comprising protrusions 208 separated by gaps 210. In this design, the protrusions 208 form a rounded edge with a shorter leading edge and extending on the trailing edge. This embodiment prevents a dispenser housing 102 from rotating in a clockwise direction and requires a sufficient force for counter-clockwise rotation. In other embodiments, the leading and trailing edges may be flipped to prevent counter-clockwise rotation and limit clockwise rotation of the dispenser 100.

The canister connector 202 includes a canister port 206, which is configured to fit around a canister's stem gasket. This canister port 206 may include threads, snap-on fittings or other connectors to attach the canister connector 202 to the canister's stem gasket. In this embodiment, the canister connector 202 also includes a sleeve 216 that fits around a base 214 of stem connector 204.

The stem connector 204 includes an output nozzle 212 and base 214. When assembled in an actuator, the shoulder 218 (see FIG. 12) of the base 214 next to the output nozzle 212 contacts the actuator plunger 128. The actuator plunger 128 is pressed against this shoulder 218 to control the valve stem and the release of contents from the canister 118.

The combination 200 illustrates interchangeable components of the actuator. For example, a series of the canister connectors 202 may be available with different canister ports 206, which each connect to different stem gaskets 122 of canisters 118. In addition, a series of stem connectors 204 may be available that correspond to different valve options. For example, the stem connector 204 may include an extended valve stem to fit a female canister valve or a port to accept a male canister valve.

Figure 9:
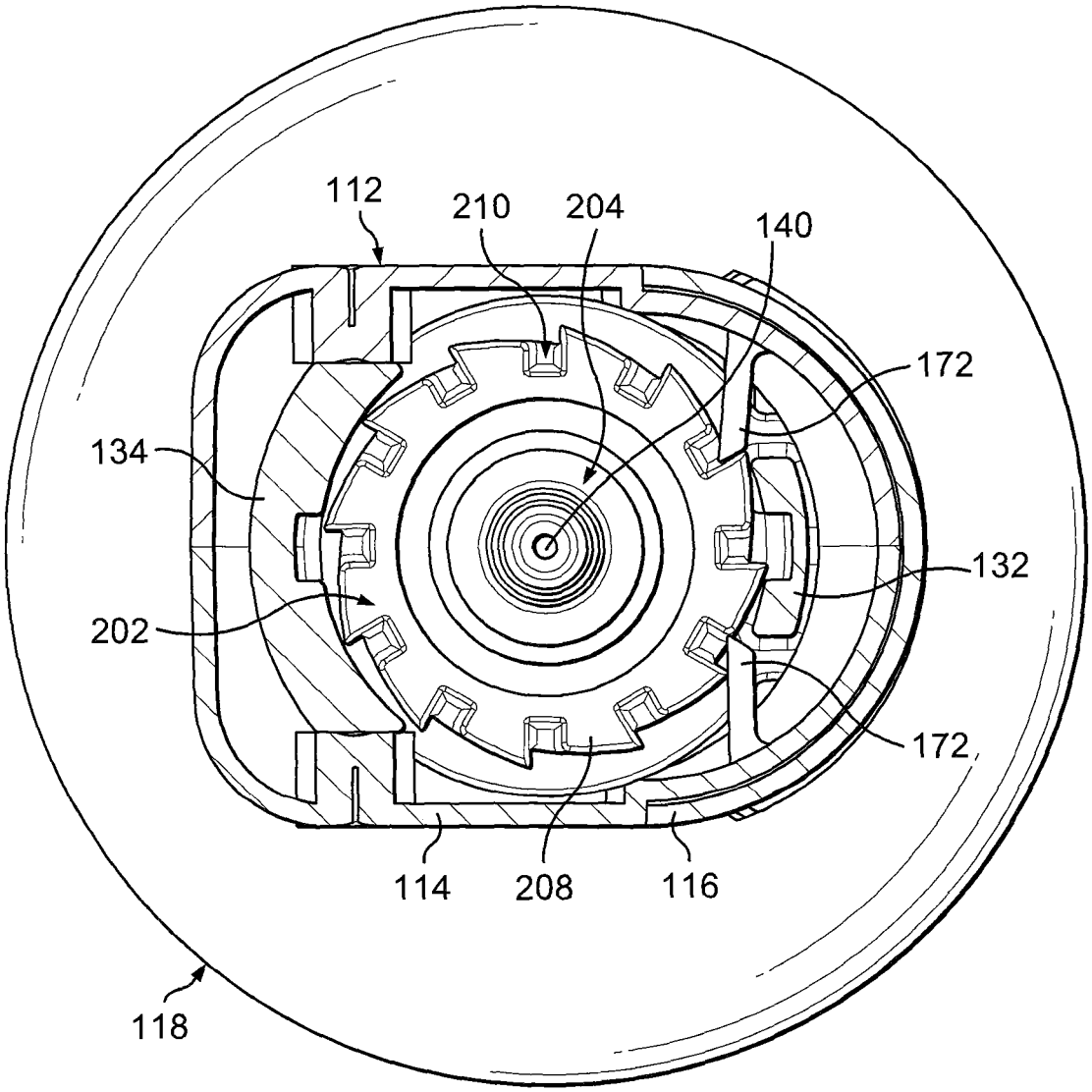
FIG. 9 is a top, cross-section view of an embodiment of a dispenser.

FIG. 9 shows a top-down, cross-section view of the dispenser housing 102 with the canister connector 202 and stem connector 204. The tines 172 on each side wall 112 and 114 engage the gaps 210 of the canister connector 202. In this configuration, the angled points of the tines 172 and design of the protrusions 208 correspond to limit the ability to rotate the dispenser housing 102 relative to the canister connector 202 and the canister 118. In this configuration, the tines 172 and the ratcheted edge 142 prevent the dispenser housing 102 from rotating in a clockwise direction because the tine 172 on side wall 112 will wedge into the gap 210 and press against the trailing side of the protrusions 208. In addition, the tine 172 on side wall 114 will limit any counter-clockwise rotation until a sufficient pressure is applied to cause the leading edge of the ratcheted edge 142 and the angle of the tine 172 to pass each other and allow rotation.

Figure 10:
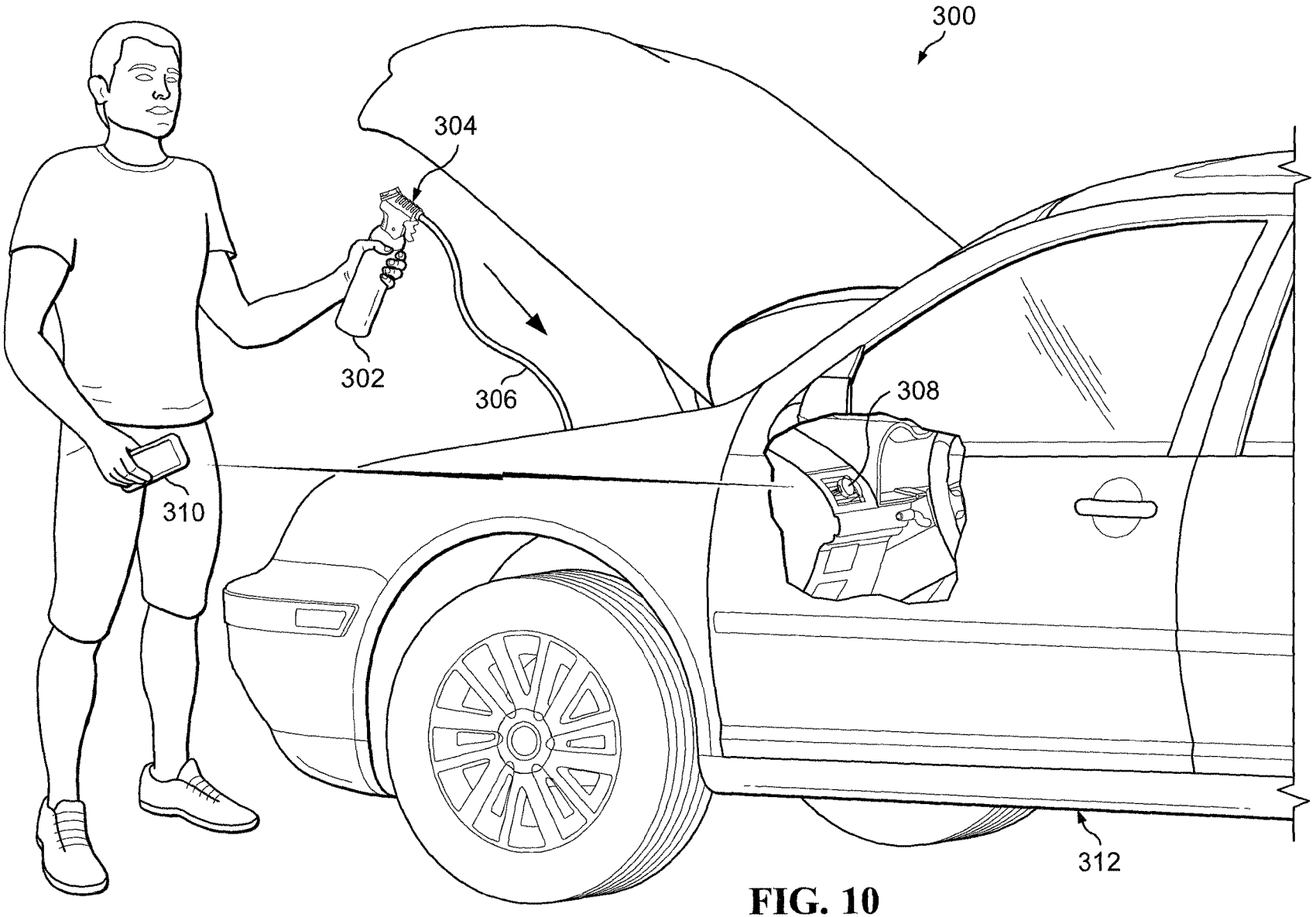
FIG. 10 is a view of an automotive application using an embodiment of an actuator and a canister.

FIG. 10 shows an illustrative use of a refrigerant charging system 300 for an automobile 312. The person has a canister 302 containing a refrigerant to charge the automobile 312's air conditioning system. The canister 302 has a dispenser 304 with an output hose 306, which is connected to the vehicle or automobile refrigerant system. The dispenser 304 may be configured like the dispensers described herein, having an internal actuator within a housing. The refrigerant charging system 300 includes a sensor 308 clipped into a vehicle air vent. Prior to use, the sensor 308 may be held in a sensor opening of the dispenser housing. The refrigerant charging system 300 also incorporates the user's mobile device 310. The complete refrigerant charge system 300 is available through a canister 302 with the dispenser 304, which holds the sensor 308, and a mobile application available for the user on their own mobile device 310.

In this embodiment, the sensor 308 detects humidity and temperature in the airflow from the vent of the automobile 312. The sensor 308 will take baseline ambient temperature and humidity readings to begin. The sensor 308 will continue to read the temperature and humidity and will communicate the readings via a wireless communication to the mobile device 310.

The application on the mobile device 310 will process the humidity and temperature from the initial reading to determine when the change in temperature and humidity indicates that the air conditioning system is fully charged. At such time, the application may display instructions for the user to stop charging the system. In some embodiments, the application may display color-coded signals to indicate the stage of the charging process. For example, the application may begin green, then change to yellow as the temperature and humidity approach the charged state and red when the charged state is reached. Ensuring that the air conditioning system is not overcharged protects the system from potential damage.

In alternative embodiments, the application may send a signal using the wireless communication of the mobile device 310 to a wireless control within the dispenser 304, which shuts off the flow of refrigerant. In other embodiments, the sensor 308 may determine when a threshold is reached to stop charging the air conditioning system. Once the threshold is met, the sensor 308 may send a signal to the mobile device 310 or a wireless feature of the dispenser 304.

To use the refrigerant charging system 300, the user may remove the sensor 308 from the sensor opening in the dispenser 304 and attach it to the air vent. For example, the sensor 308 may include a clip that snaps onto the automobile 312's vent. The user may also connect the hose 306 to the automobile 312's air conditioning system for recharging refrigerant. The user may also open a monitoring application in the mobile device 310. The mobile device 310 and the sensor 308 may pair to ensure real-time communication.

With the setup complete, the user or another person may start the automobile 312 and turn the air conditioning system on. The user may then begin charging the air conditioning system by pulling the trigger on the dispenser 304. The user may hold the trigger down while watching the application running on the mobile device 310. When the application indicates the air conditioning system is fully charged, the user releases the trigger of the dispenser 304 to stop charging the system. The application may provide a visual, auditory or sensory indication through the display, speakers or vibratory output of the mobile device 310.

Figure 11:
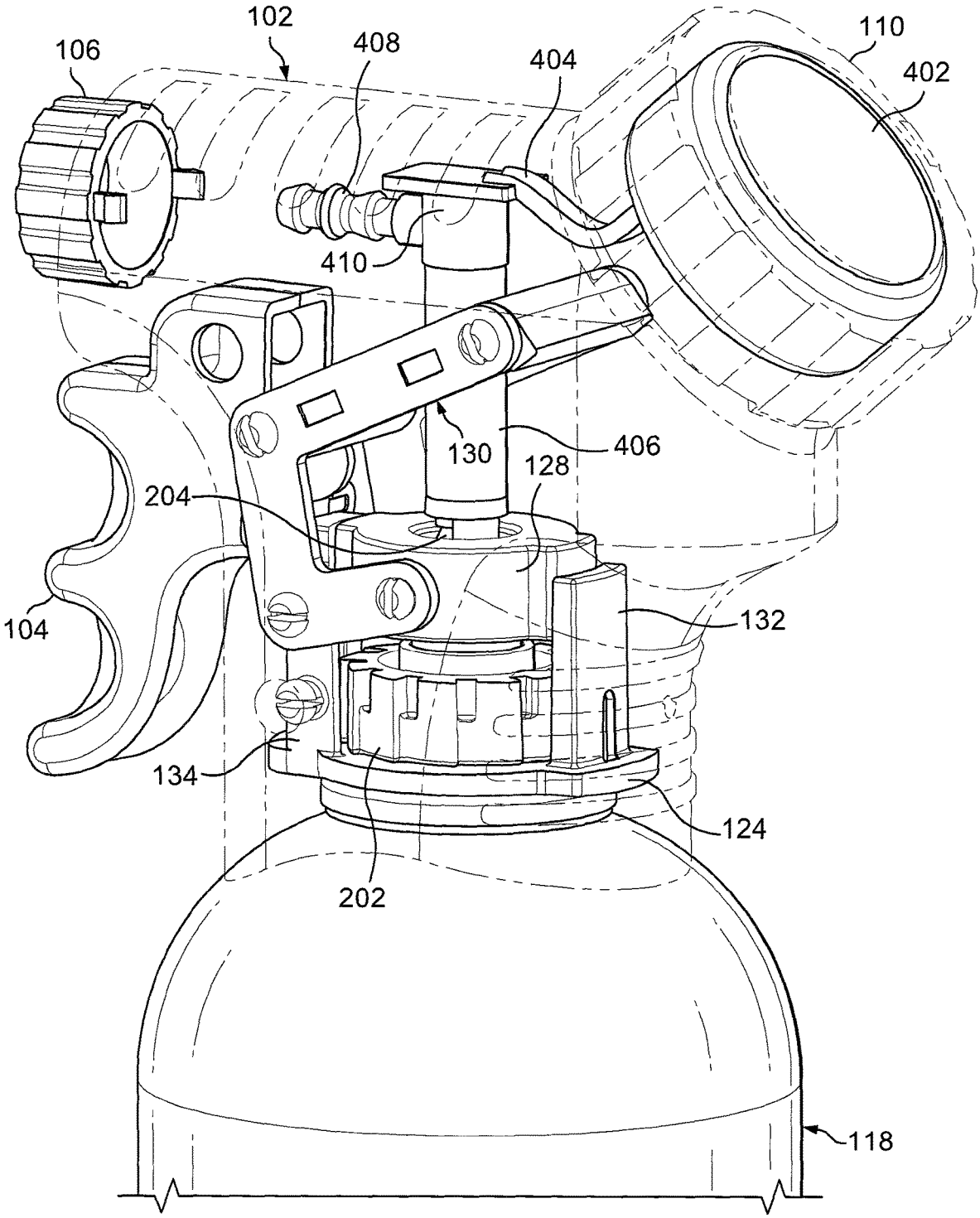
FIG. 11 is a perspective view of another embodiment of a dispenser showing internal components.
Figure 12:
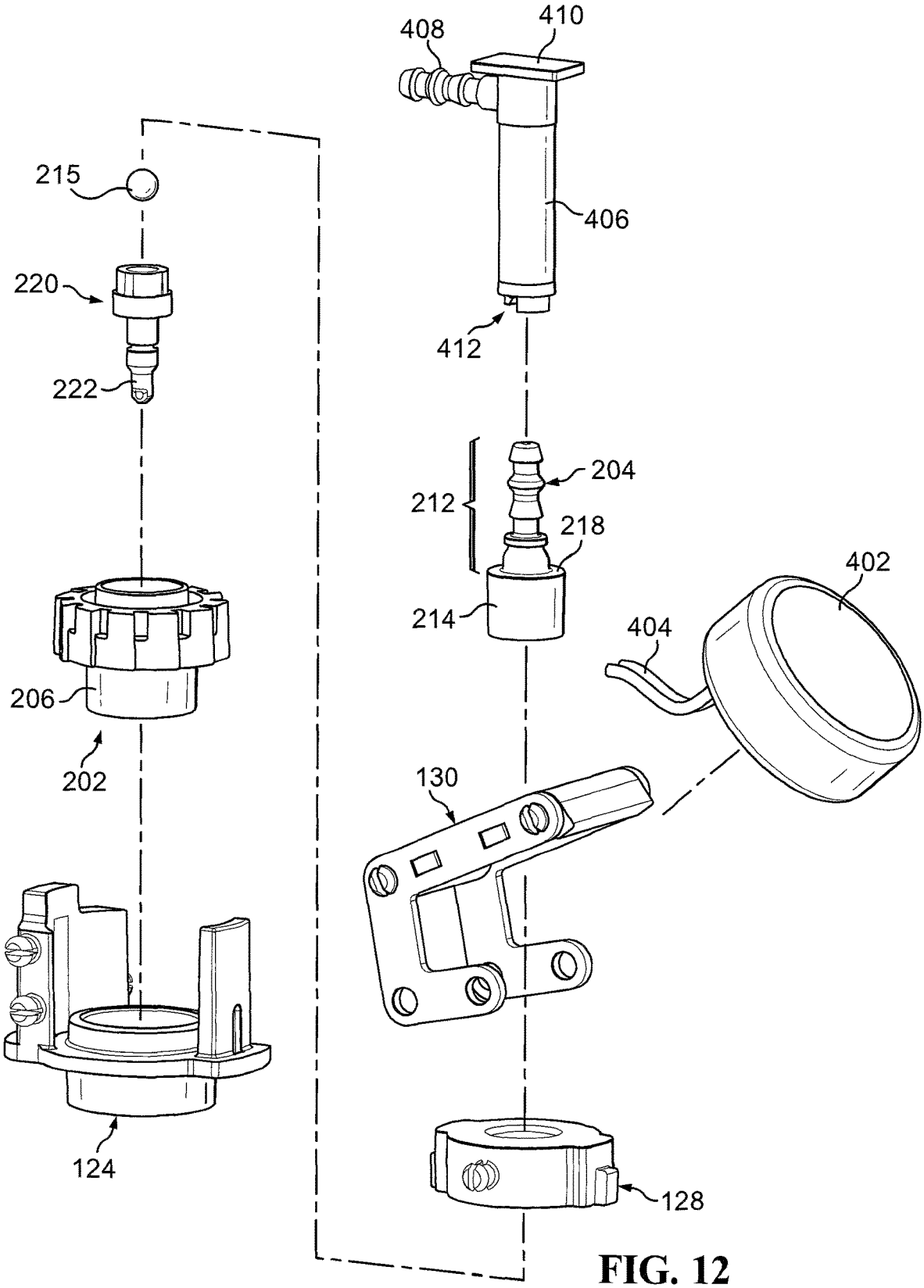
FIG. 12 is an exploded view of another embodiment of an actuator and sensor.

FIGS. 11 and 12 show another embodiment of a dispenser for a canister 118. The dispenser housing 102 is shown in dashed lines for context around the actuator and sensor 402. The actuator includes the actuator control 130 attached to the actuator frame 124 and actuator plunger 128. The actuator frame 124 is held to the canister 118 by canister connector 202 having a ratcheted edge to orient the dispenser housing 102. The exploded view in FIG. 12 shows the internal actuator components including the actuator control 130, actuator plunger 128, canister connector 202 and actuator frame 124. FIG. 12 also includes the nozzle extender 406, stem connector 204, one-way ball check valve stem fitting 220, including a ball 215 to block reverse flow of fluid through the output nozzle 212, and sensor 402. The one-way ball check valve 220 prevents refrigerant intended for the vehicle refrigerant system from being forced back into the canister, while allowing refrigerant to flow freely from the canister to the vehicle.

The stem connector 204 is illustrated in the space 180 (see FIG. 5) between the actuator plunger 128 and the canister connector 202. In this embodiment, the output nozzle 212 of the stem connector 204 is attached to a nozzle extender 406. In this embodiment, the extension port 412 of the nozzle extender 406 attaches to the output nozzle 212. In this embodiment, nozzle extender 406 passes through the opening of the actuator control 130. A sensor connection 410 is located at the top of the nozzle extender 406 and an extension nozzle 408 extends toward the output opening. A hose or other output may connect to the extension nozzle 408. The extension nozzle 408 may include an O-ring or other seal to prevent leaks between the extension nozzle 408 and output component, such as a hose, tube or other output.

The sensor connection 410 connects to a sensor 402 by wires 404 in this embodiment. In other embodiments, the sensor 402 may be connected by other operational connections than wires 404, such as pressure tubes, fiber or other operable connections. The sensor connection 410 may include sensor components such as a pressure transducer, diaphragm, baffle, thermocouple, temperature detector or other sensor component. The sensor 402 may include a display, speaker or other output to provide a user feedback on the operation of the dispenser.

Some embodiments may not include a nozzle extender 406. The sensor 402 may connect to a sensor port on the stem connector 204 or a separate sensor connection attached to the output nozzle 212. Other embodiments may include alternative nozzle extenders 406. The nozzle extenders 406 may vary in shape, size and features. For example, a nozzle extender 406 may curve through the opening of the actuator control 130. In another embodiment, a nozzle extender 406 may be made from a flexible material. In another embodiment, the nozzle extender 406 may include a viewing panel to the exterior of the dispenser housing 102 to see the flow of contents from the canister 118.

The nozzle extender 406 provides an extension port 412, which fits onto the output nozzle 212 of the stem connector 204. The output nozzle 212 may include an O-ring, gasket or other sealing component to prevent leaks between the output nozzle 212 and the extension port 412. The stem connector 204 passes through the actuator plunger 128 when assembled. The shoulder 218 engages the bottom of the actuator plunger 128 and the output nozzle 212 extends through the opening in the actuator plunger 128.

The base 214 of the stem connector 204 attaches to the one-way ball check valve stem fitting 220. In this embodiment, the one-way ball check valve stem fitting 220 includes an extended valve stem 222 to fit a female valve gasket of a canister 118. In other embodiments, the one-way ball check valve stem fitting 220 may have a port to accept a valve stem extending from a canister 118. The valve stem 222 extends through the canister connector 202 into the canister 118.

When the user pulls or squeezes the trigger 104, the actuator control 130 moves the actuator plunger 128 down. The actuator plunger 128 pushes the shoulder 218 of the stem connector 204 and thereby pushes the extended valve stem 222 into the canister 118 to release the contents of the canister 118. The contents of the canister 118 flow through the extended valve stem 222 and one-way ball check valve stem fitting 220, the stem connector 204, the nozzle extender 406 and out through an output hose or other output feature. It will be understood that the dispenser may be reconfigured from activation by a trigger to use of a push button or to a rotating button. As previously mentioned, the sensor opening in the dispenser housing may be adapted to receive a alternate accessories, for example, a digital pressure gauge, having either a round or rectangular display. As the contents flow through the nozzle extender 406, the sensor 402 measures one or more features of the content flow. For example, the sensor 402 may measure the pressure of the flow of contents and show a display of the pressure to the user.

Figure 13:
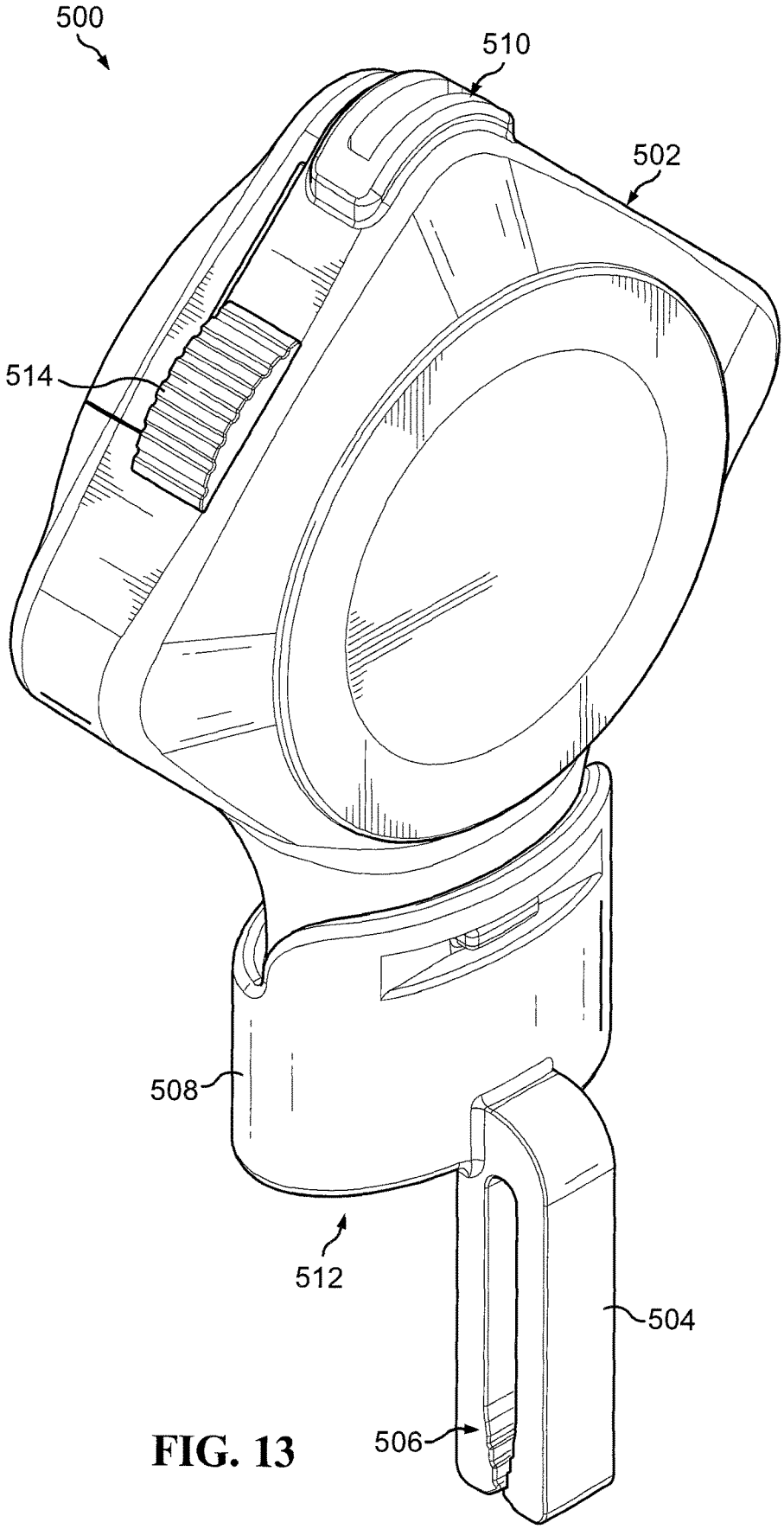
FIG. 13 is a perspective view of a portable sensor.

FIG. 13 shows an alternative wireless sensor 500. This sensor 500 may communicate with a mobile device application for recharging refrigerant to a vehicle refrigerant system. The sensor 500 includes a clip 504 with teeth 506. The clip 504 and teeth 506 may grip an air vent or vane to hold the sensor 500 in the path of the airflow from an air conditioning output. The clip 504 is built into the base 508 in this embodiment. Some embodiments may include an alternative attachment mechanism for the sensor 500 than the clip 504.

The base 508 is snapped onto the bottom of the sensor body 502. The bottom of the base 508 includes an opening to an air inlet vent 512. During operation, the air from the air conditioning system flows into the sensor 500 through the air inlet vent 512. The air passes through internal components of the sensor 500 that measure characteristics of the air such as humidity, temperature and other attributes. An opening 510 in the top may also be provided to allow air to flow out of the sensor 500, or to provide access to the internal components. The internal components of the sensor 500 include sensor elements, such as thermistors, capacitive humidity sensors or other sensor elements. In addition, the sensor 500 includes a wireless communication chip or module, such as a BLUETOOTH module, ZIGBEE module or other wireless component. In addition, the internal components include a battery or other power source. The battery may be removable and replaceable. The sensor 500 also includes a switch 514 to turn the sensor 500 on and off for operation of the sensor 500 as part of a sensor system for refrigerant charging. A person may use the sensor 500 multiple times with any refrigerant.

In some embodiments, the mobile device application may include options to select the vehicle, location and refrigerant type to best select the corresponding charge thresholds for analysis. The sensor 500 provides the measurements wirelessly to the user's remote device for the application to track and analyze. In addition to guiding the refrigerant charging process, the application may store historical charging information to refine the process iteratively. This information may be tracked with prior testing information and follow-up testing information for the same vehicle or type of vehicle.

The dispenser being thus described and further described in the claims, it will be obvious that the same may be varied in many ways. Such variations are not to be regarded as a departure from the spirit and scope set forth herein, and all such modifications as would be obvious to one skilled in the art are intended to be included within the scope of the apparatus described.

The invention claimed is:

1. A dispenser system for a canister, comprising:

an actuator that controls flow of contents from the canister, the actuator comprising:

an actuator frame having a guide wall extending from a base and an opening in the base, a canister connector that fits into the base and attaches to a valve gasket of the canister, an actuator plunger that fits in the guide wall and moves between a first position and a second position along the guide wall, wherein the first position is further from the base than the second position, a stem connector having a nozzle that extends through the actuator plunger, wherein the stem connector operably connects to an output of the canister, and an actuator control that connects to the actuator plunger and moves the actuator plunger between the first position and the second position, wherein the contents do not flow out of the canister when the actuator plunger is in the first position and the stem connector causes the contents to flow out of the canister when the actuator is in the second position; and a dispenser housing having an output opening and a control opening, wherein the actuator is within the dispenser housing.

2. The dispenser system for the canister of claim 1, having a sensor opening in the dispenser housing that holds a sensor.

3. The dispenser system for the canister of claim 2, wherein the sensor is removable.

4. The dispenser system for the canister of claim 3, wherein the sensor includes a wireless communication chip, and the dispenser system includes a mobile device that receives sensor data from the wireless communication chip, wherein the mobile device provides operation instructions for dispensing the contents from the canister based on the sensor data.

5. The dispenser system for the canister of claim 3, wherein the sensor includes a clip that extends into the dispenser housing, wherein the clip prevents the actuator control from moving the actuator plunger from the first position to the second position.

6. The dispenser system for the canister of claim 1, wherein the stem connector includes a valve stem that extends into the output of the canister.

7. The dispenser system for the canister of claim 1, wherein the stem connector includes a port configured to engage a valve stem that extends from the canister, wherein the valve stem is the output of the canister.

8. The dispenser system for the canister of claim 1, wherein the canister connector comprises a ratcheted edge and the dispenser housing includes a tine extending inward, wherein the tine engages the ratcheted edge and maintains an orientation of the dispenser housing to the canister, and wherein the orientation may be rotated when sufficient force is applied to the dispenser housing.

9. The dispenser system for the canister of claim 1, wherein the actuator control has an angular J-shape design with a bottom arm, a connecting side and a top arm, wherein the bottom arm of the actuator control has a first connection with the actuator frame and a second connection with the actuator plunger, wherein the actuator control pivots around the first connection, and wherein the connecting side extends away from the canister and the top arm extends over the actuator plunger.

10. The dispenser system for the canister of claim 9, wherein the dispenser system further includes a trigger in the control opening, wherein, when the trigger is moved toward the dispenser housing, the trigger pushes the connecting side of the actuator control, causing the actuator control to rotate and the actuator plunger to move to the second position.

11. The dispenser system for the canister of claim 1, further comprising a nozzle extender that connects to the nozzle and passes through the actuator control.

12. The dispenser system for the canister of claim 11, wherein the nozzle extender connects to a sensor attached to the dispenser housing, wherein the sensor provides a user output based on sensor data.

13. An actuator for a canister dispenser system, comprising:

an actuator frame having a first guide wall and a second guide wall spaced opposite from one another, and each extending from a base that includes an opening;

a canister connector that fits into the opening in the base and attaches to a valve gasket of the canister;

an actuator plunger that fits between the first guide wall and the second guide wall and moves between a first position and a second position along the first guide wall and the second guide wall, wherein the first position is further from the base than the second position;

a stem connector having a nozzle that extends through the actuator plunger, wherein the stem connector operably connects to an output of the canister; and an actuator control that connects to the actuator frame and the actuator plunger;

wherein the actuator control moves the actuator plunger between the first position and the second position, wherein contents do not flow out of the canister when the actuator plunger is in the first position and the stem connector causes the contents to flow out of the canister when the actuator is in the second position; and wherein the actuator control is configured to move the actuator plunger based on pressure applied to at least one of a front contact point or a top contact point.

14. The actuator for the canister dispenser system of claim 13, wherein the actuator control has an angular J-shape design with a bottom arm, a connecting side and a top arm, wherein the bottom arm of the actuator control has a first connection with the actuator frame and a second connection with the actuator plunger, wherein the actuator control pivots around the first connection, and wherein the connecting side extends away from the canister and the top arm extends over the actuator plunger, and wherein the front contact point is on the connecting side.

15. The actuator for the canister dispenser system of claim 13, wherein the canister connector has right-hand threads that connect to corresponding threads on the valve gasket.

16. The actuator for the canister dispenser system of claim 13, wherein the canister connector has left-hand threads that connect to corresponding threads on the valve gasket.

17. The actuator for the canister dispenser system of claim 13, wherein the stem connector includes a valve stem that extends into the output of the canister.

18. The actuator for the canister dispenser system of claim 13, wherein the stem connector includes a port configured to engage a valve stem that extends from the canister, wherein the valve stem is the output of the canister.

19. The actuator for the canister dispenser system of claim 13, wherein the canister connector comprises a ratcheted edge that corresponds to a tine extending inward from a dispenser housing, which encases the actuator, wherein the tine engages the ratcheted edge and maintains an orientation of the dispenser housing to the canister, and wherein the orientation may be rotated when sufficient force is applied to the dispenser housing.

20. The actuator for the canister dispenser system of claim 13, further comprising a nozzle extender that connects to the nozzle and passes through the actuator control.

21. The actuator for the canister dispenser system of claim 13, the nozzle extender connects to a sensor attached to the dispenser housing, wherein the sensor provides a user output based on sensor data.

* * * * *